US008240802B2

(12) United States Patent
Nakano et al.

(10) Patent No.: US 8,240,802 B2
(45) Date of Patent: Aug. 14, 2012

(54) PRINTING APPARATUS AND METHOD FOR ADJUSTING PRINTING POSITION

(75) Inventors: Takatoshi Nakano, Tokyo (JP); Kiichiro Takahashi, Yokohama (JP); Minoru Teshigawara, Saitama (JP); Tetsuya Edamura, Kawasaki (JP); Akiko Maru, Tokyo (JP); Hiroshi Taira, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 310 days.

(21) Appl. No.: 12/817,360

(22) Filed: Jun. 17, 2010

(65) Prior Publication Data

US 2010/0321436 A1 Dec. 23, 2010

(30) Foreign Application Priority Data

Jun. 23, 2009 (JP) ..... 2009-148826

(51) Int. Cl.
*B41J 29/38* (2006.01)
*B41J 29/393* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS 5,847,722 A * 12/1998 Hackleman ..... 347/19
5,923,344 A * 7/1999 Norum et al. ..... 347/9
6,588,872 B2 * 7/2003 Anderson et al. ..... 347/19
7,114,790 B2 10/2006 Seki et al.
7,258,429 B2 8/2007 Takahashi et al.
7,273,262 B2 * 9/2007 McGarry et al. ..... 347/19
7,458,655 B2 12/2008 Takahashi et al.
2009/0073202 A1 3/2009 Kanda et al.
2009/0174741 A1 7/2009 Nagata et al.
2011/0032296 A1 2/2011 Nakano et al.
2011/0037799 A1 2/2011 Nakano et al.
2011/0047403 A1 2/2011 Seki et al.

FOREIGN PATENT DOCUMENTS

JP 2002-120360 A 4/2002
JP 2006-027162 A 2/2006
JP 2009-066972 A 4/2009
JP 2009-154376 A 7/2009

OTHER PUBLICATIONS

Extended European Search Report, Appln. No. 10008237.9-2304, European Patent Office, dated Jan. 25, 2011.

* cited by examiner

*Primary Examiner* — Stephen Meier
*Assistant Examiner* — Jeremy Bishop
(74) *Attorney, Agent, or Firm* — Fitzpatrick, Cella, Harper & Scinto

(57) ABSTRACT

By subtracting a first parameter related to the printing position deviation inherent to the printing head from a second parameter that is obtained by actually measuring the printing position deviation in a state where the printing head is mounted on the printing apparatus, a third parameter related to the printing position deviation inherent to the printing apparatus is acquired. When a new printing head is mounted on the printing apparatus, a new second parameter is computed from the third parameter and a first parameter that is of the new printing head. By this procedure, it is possible to hold down a time required for actual measurement of the printing position deviation and consumables, and even when the printing head is exchanged, it becomes possible to stably output a uniform image free from the printing position deviation.

7 Claims, 15 Drawing Sheets

| NUMBER OF TIMES OF EJECTION | 0～2.5×10^8 | 2.5×10^8～3×10^8 | 3×10^8～ |
|---|---|---|---|
| PRINTING POSITION SET VALUE δ AT THE TIME OF ENDURANCE | 0 | 2 | 4 |

FIG.15

PRINTING APPARATUS AND METHOD FOR ADJUSTING PRINTING POSITION

BACKGROUND OF THE INVENTION

1. Field of the Invention

The present invention relates to a method for adjusting a printing position of a dot in dot-matrix printing. Especially, it relates to a method for simplifying an adjustment process of the printing position at the time of exchange of a printing head etc. in a printing apparatus that uses a detachable printing head.

2. Description of the Related Art

In inkjet printing apparatuses, with the increased use of multiple colors in images, there have spread many ones each of which has a form such that a plurality of printing heads are mounted on a carriage and an image is printed while that carriage is being scanned. Regarding the printing head, there are many ones that are detachable to their carriages. In this case, adjustment of the printing position is regularly conducted each time the printing head is exchanged.

Hereafter, the adjustment of the printing position will be explained briefly. In the printing apparatus and the plurality of printing heads, a certain amount of variation is inevitably included therein because of its manufacture process, relationships of positions of the plurality of printing heads when being mounted on the carriage become various.

FIGS. 1A to 1D are schematic diagrams for explaining variation in placement between the printing heads when four printing heads are mounted on the carriage in parallel. In FIG. 1A, ejection outlets 94 for ejecting an ink as droplets are arranged with a predetermined pitch in a Y-direction in each of four printing heads 90 to 93. If there are no deviations in arrangements of the respective printing heads 90 to 93 and the carriages 95 to 98 on which these respective printing heads are mounted, ejection outlet arrays of the four printing heads are placed at the same position in the Y-direction in parallel as shown in the figure.

Contrary to this case, if there occurs an installation error, for example, among the printing head 91 or the carriage 96 that carries this, the ejection outlet array of the printing head 91 will have an inclination or will be shifted to the other three ejection outlet arrays. FIG. 1B shows a case where the ejection outlet array of the printing head 91 is deviated in the Y-direction compared with the other ejection outlet arrays. Moreover, FIG. 1C shows a case where the ejection outlet array of the printing head 91 is deviated in an X-direction compared with the other ejection outlet arrays. Furthermore, FIG. 1D shows a case where the ejection outlet array of the printing head 91 is inclined compared with the other ejection outlet arrays.

If there is an error of a whichever kind in a whichever direction, in the state shown in FIGS. 1B to 1D, there occurs a result that the dots printed by the printing head 91 deviate from the dots printed by the other printing heads on a printing medium. In addition, even regarding the printing head 91 alone, there is also a case where a printing position deviation occurs between the dots printed by an outward scan and the dots printed by a return scan. Then, such printing position deviations become causes of streaks or density unevenness in an image printed on the printing medium, and impair uniformity of the image.

Therefore, in the printing apparatus whose printing head is exchangeable, it was common to detect deviation quantity of the printing position from a printed test pattern and then to adjust a timing of ejecting the ink depending on the acquired deviation quantity at the time of printing as is disclosed, for example, in Japanese Patent Laid-Open No. 2002-120360.

Digressing momentarily, the printing position deviation of the printing head has several kinds as follows: a printing position deviation among the plurality of printing heads (among ink colors); a deviation caused by the inclination of the each printing head; a printing position deviation between the outward scan and the return scan. Moreover, recently, cases where inks of many more colors consisting of fundamental four colors (CMYK) plus several additional colors are used in order to enhance color reproducibility are increasingly carried out into practice. Therefore, when detecting the printing position deviation, there arises a need for printing the test patterns different in these kinds or the ink colors and detecting the deviation quantities for the respective test patterns. However, if these test patterns are printed and the respective printing position deviations are detected not only at the time of delivery of the printing apparatus but also each time the printing head is exchanged, large quantities of inks, printing media, and time will be consumed for this detection.

SUMMARY OF THE INVENTION

The present invention is made in order to solve the above-mentioned problem. Therefore, what the present invention aims at is to provide a method for adjusting a printing position deviation that can stably adjust the printing position deviation while conducting as small a number of steps of detecting the printing position deviation as possible even in the case of the printing apparatus that carries a detachable printing head.

The first aspect of the present invention is a printing apparatus comprising: a mounting unit capable of mounting a printing head in which a plurality of ejection outlet ejecting an ink are arranged: the printing head storing a first parameter related to a printing position deviation inherent to the printing head; a printing unit configured to print dots on a printing medium by ejecting an ink from the printing head; a detecting unit configured to detect a printing position deviation with the printing head mounted on the printing apparatus; an unit configured to store a second parameter related to the printing position deviation with the printing head mounted on the printing apparatus; an unit configured to correct positions at which the printing head prints dots on the printing medium according to the second parameter; an unit configured to derive a third parameter related to the printing position deviation inherent to the printing apparatus from the first parameter and the second parameter; an unit configured to store the third parameter; and an updating unit configured to update the second parameter, when a new printing head is mounted on the printing apparatus, from the third parameter and the first parameter of the new printing head.

The second aspect of the present invention is a method for adjusting printing positions, comprising steps for: mounting a printing head for printing dots on a printing medium to a printing apparatus: the printing head storing a first parameter related to a printing position deviation inherent to the printing head; detecting a printing position deviation with the printing head mounted on the printing apparatus; storing a second parameter related to the printing position deviation with the printing head mounted on the printing apparatus; correcting positions at which the printing head prints dots on the printing medium according to the second parameter; deriving a third parameter related to the printing position deviation inherent to the printing apparatus from the first parameter and the second parameter; storing the third parameter; and updating the second parameter, when a new printing head is mounted on the printing apparatus, from the third parameter and the first parameter of the new printing head.

Further features of the present invention will become apparent from the following description of exemplary embodiments with reference to the attached drawings.

BRIEF DESCRIPTION OF THE DRAWINGS

FIG. 15 is a diagram showing a relationship of the number of times of ejection of the printing head and an adjustment value δ.

DESCRIPTION OF THE EMBODIMENTS

First Embodiment

Figure 1A:
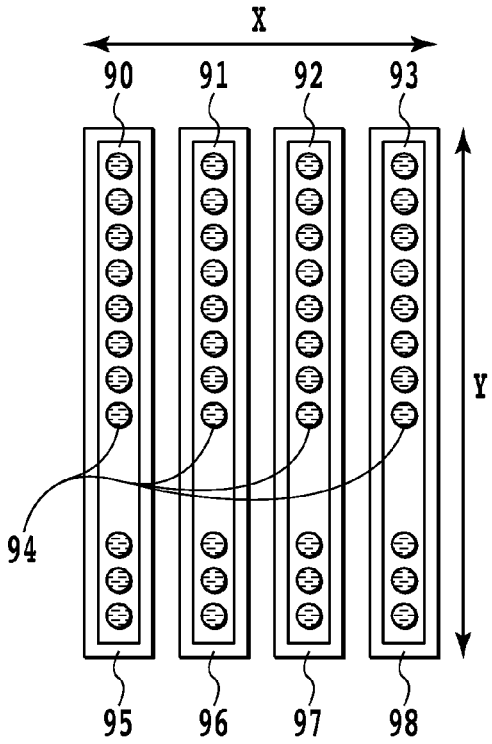
FIGS. 1A to 1D are diagrams showing a variation in placement among four printing heads.
Figure 1C:
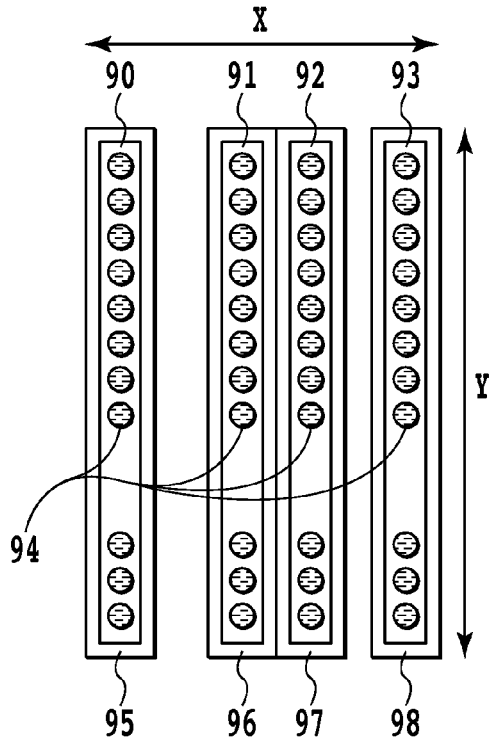
Figure 1B:
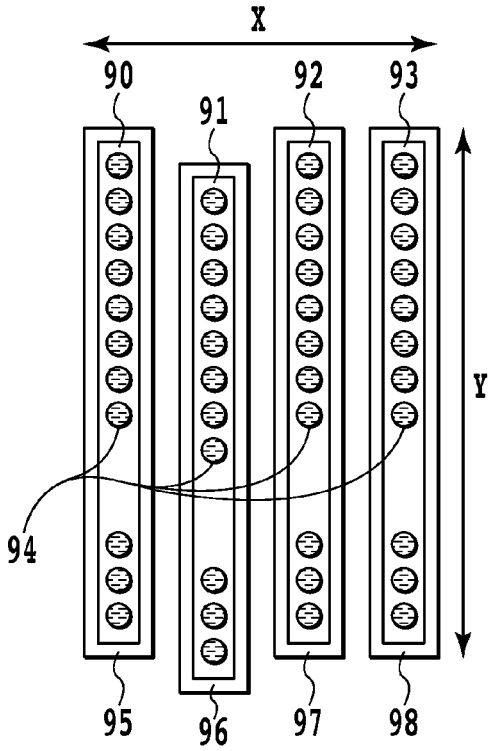
Figure 1D:
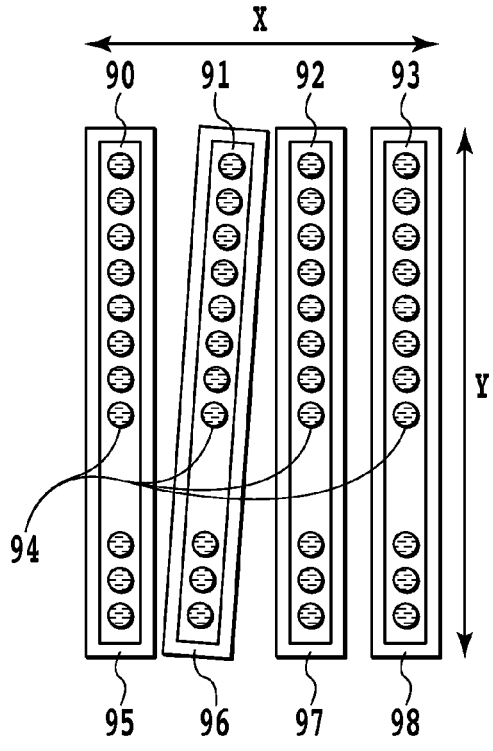
Figure 2:
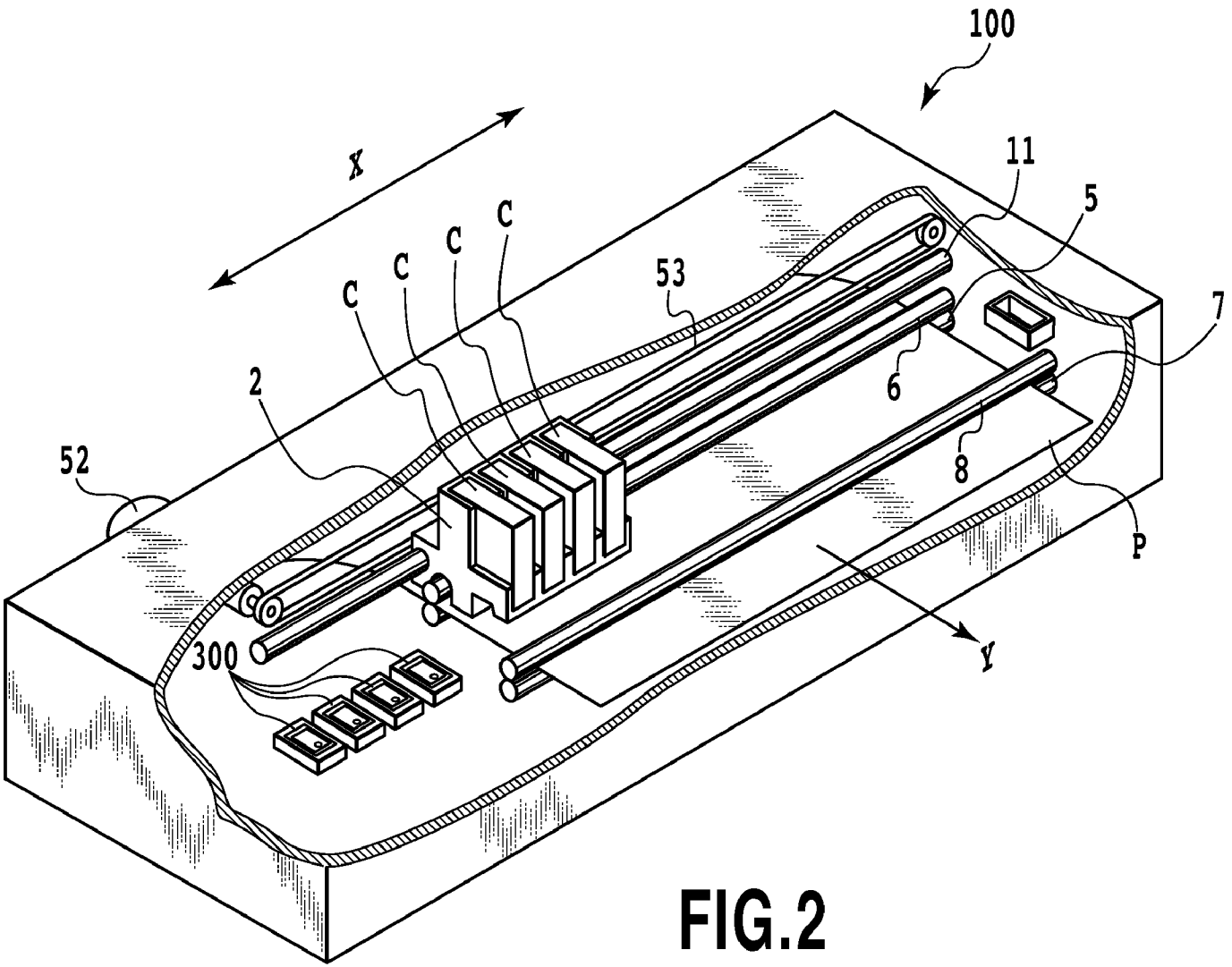
FIG. 2 is a diagram showing an outline configuration of an ink jet printing apparatus used in an embodiment.

FIG. 2 is a diagram for explaining an outline configuration of an ink jet printing apparatus 100 used in this embodiment.

In the figure, a component C is an ink jet cartridge (hereinafter referred to as a cartridge) that has an ink tank in its upper part and a printing head in its lower part, and is further provided with a connector for receiving signals for driving the printing head. In this embodiment, the four cartridges C are prepared corresponding to inks of four colors (cyan, magenta, yellow, and black), and each of them is mounted on a carriage 2 detachably.

The carriage 2 is made capable of performing a reciprocal movement in a main scanning direction (an X-direction) while being supported and guided by a scanning rail 11 with a driving force of a carriage motor 52 that is transferred through a driving belt 53. The each printing head ejects the ink toward a printing medium P following a printing signal during the movement in the X-direction (under scanning). Incidentally, at a position that is abreast with the printing head of the carriage 2, an optical sensor for reading a test pattern printed by the printing head is provided.

Each time the scanning by the printing head is performed once, the printing medium P is conveyed by an amount corresponding to a printing width of the printing head in a Y-direction crossing the X-direction. The printing medium P is sandwiched between a conveyance roller pair (5 and 6) placed on an upstream side of a printing area zoned by the printing head and a paper discharging roller pair (7 and 8) placed on a downstream side of the printing area, and is conveyed to the Y-direction with the rotation of theses roller pairs in a state where smoothness of the printing area is maintained. Furthermore, an unillustrated platen is disposed in the printing area and supports the printing medium P located in the printing area from the beneath.

At an end of a movement area of the carriage 2, a recovery system unit 300 for performing a maintenance processing of the printing head is disposed. The recovery system unit 300 performs capping on the printing head that has moved here, a suction recovery processing for removing impurities, bubbles, etc. in the printing head, etc., and does other things.

Figure 3:
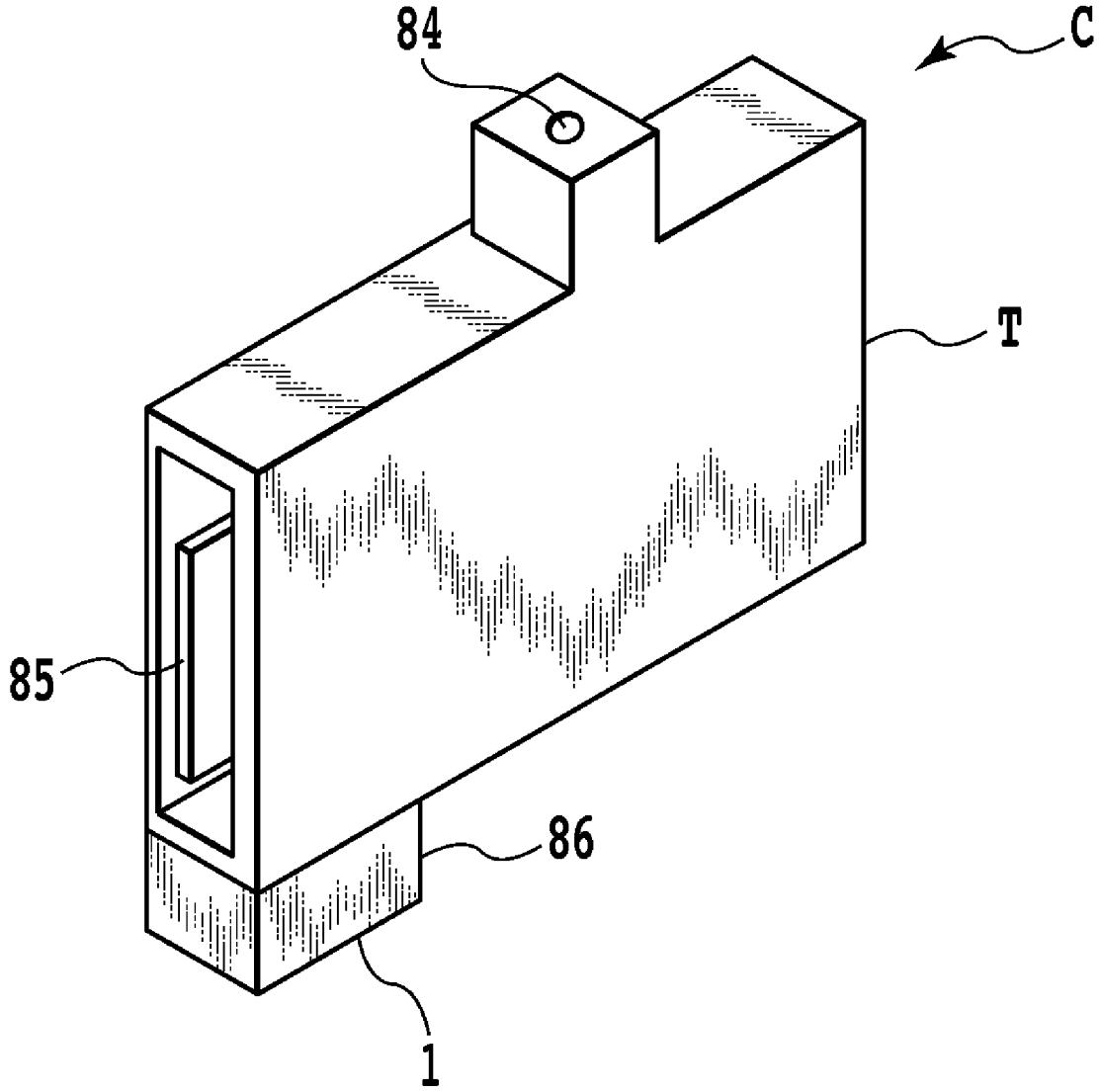
FIG. 3 is a perspective view of an ink jet cartridge C.

FIG. 3 is a perspective view of the ink jet cartridge C in which the printing head and the ink tank are integrated in one piece. The cartridge C mainly consists of an ink tank T for accommodating the ink and a printing head 86 for ejecting the ink supplied from the ink tank T. The upper part of the ink tank is provided with a though hole 84 for keeping a pressure in the tank equal to the atmospheric pressure. Moreover, at a position that is abreast with the ink tank, a connector 85 that enables it to communicate with a main board of the apparatus main frame by making connection with an unillustrated flexible cable is disposed. The connector 85 receives image data for driving the printing head from the main board, transmits information of the printing head, for example, an ink residual quantity, the number of times of ejection, etc. to the main board, and does other things.

In the printing head 86, a plurality of ejection outlets serving as outlets of ink droplets are arranged in an ejection outlet plane 1 that is a bottom side of the view. Furthermore, in its interior, an ink path for guiding the ink supplied from the ink tank T to each ejection outlet and an electrothermal transducer for ejecting the ink in the ink path in response to the printing signal are placed.

Moreover, although not shown in the figure, the printing head of this embodiment is equipped with memory for storing information peculiar to the each printing head. In addition, at the time of manufacture of the printing head, an inclination of the arrangement direction of the ejection outlets of the each printing head, etc. are measured, and that information is stored in the memory. After the printing head is mounted on the carriage of the printing apparatus, that information is provided to the main board of the apparatus through the connector 85 and a flexible cable.

Figure 4:
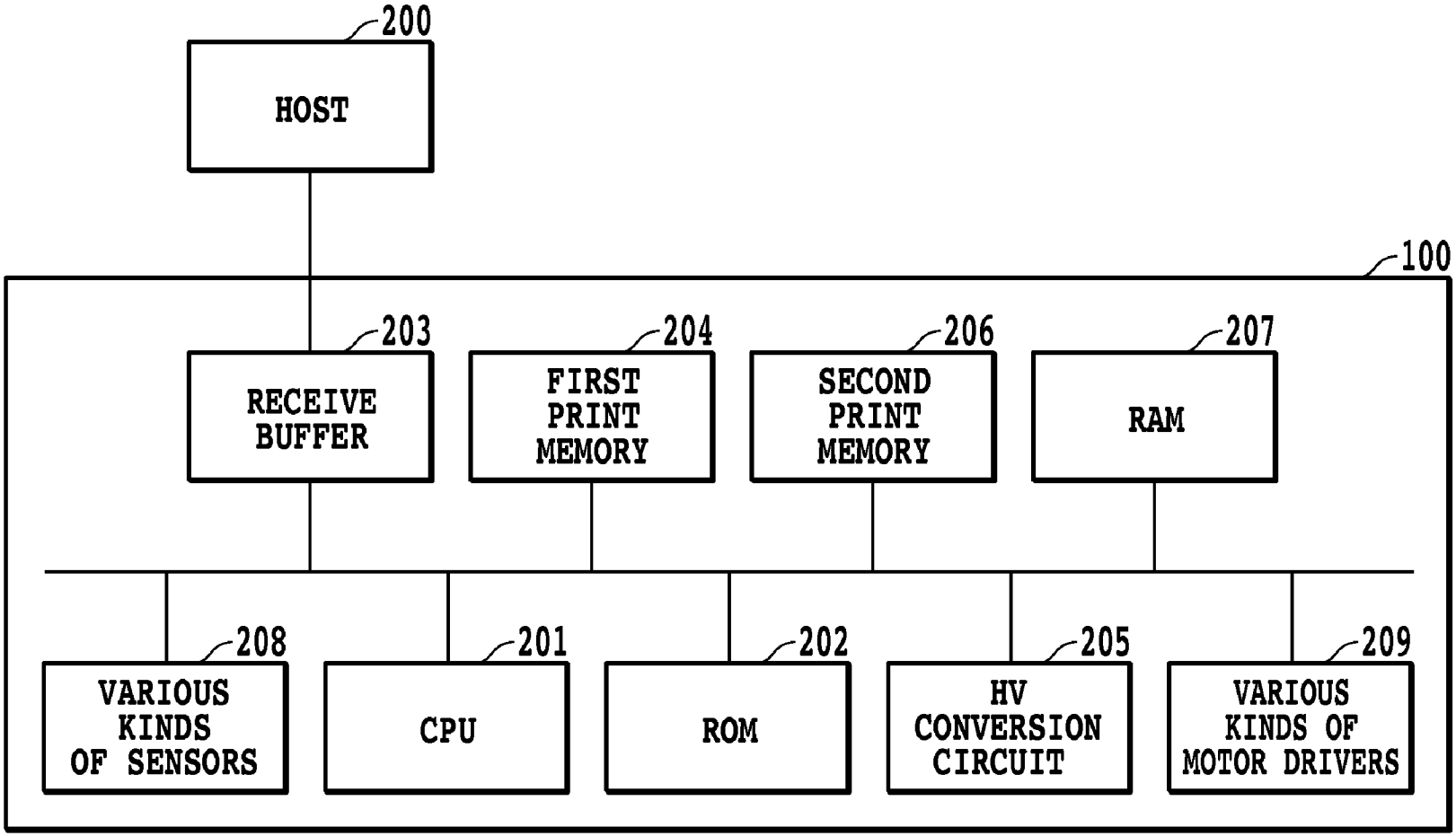
FIG. 4 is a block diagram showing a configuration of control in the ink jet printing apparatus.

FIG. 4 is a block diagram for explaining a configuration of control in the ink jet printing apparatus of this embodiment. A CPU 201 controls various operations in the apparatus using RAM 207 as a processing area according to a control program and parameters that are stored in ROM 202. For example, the CPU 201 makes the carriage 2 scan, makes the printing medium conveyed, and makes the printing head eject the ink by driving various kinds of motor-drivers 209. Moreover, from various kinds of sensors 208 including the optical sensor, a temperature sensor, etc. disposed in the apparatus, the CPU 201 also acquires pieces of information thereof.

Upon reception of the image data from a host 200 connected to the outside of the printing apparatus 100, the CPU 201 temporarily stores this in a receive buffer 203. Since the image data stored in the receive buffer 203 is compressed, the CPU 201 decompresses this compressed data to first print memory 204. After that, the image data that is decompressed to the first print memory 204 is subjected to an HV conversion processing by an HV conversion circuit 205, and is stored in second print memory 206. The data memorized in this second print memory 206 becomes print data whereby the printing head actually carries out ejection and the CPU 201 transfers this to the connectors 85 of the respective colors on the printing head side each time the scanning is performed.

Hereafter, characteristic matters of this embodiment will be explained. Here, for simplicity, a case where correction values of printing position deviations caused by the inclination of one printing head and the inclination of the printing apparatus are acquired will be explained. This embodiment is characterized in that the printing position deviation inherent to the printing apparatus and the printing position deviation inherent to the printing head are managed individually.

Figure 6A:
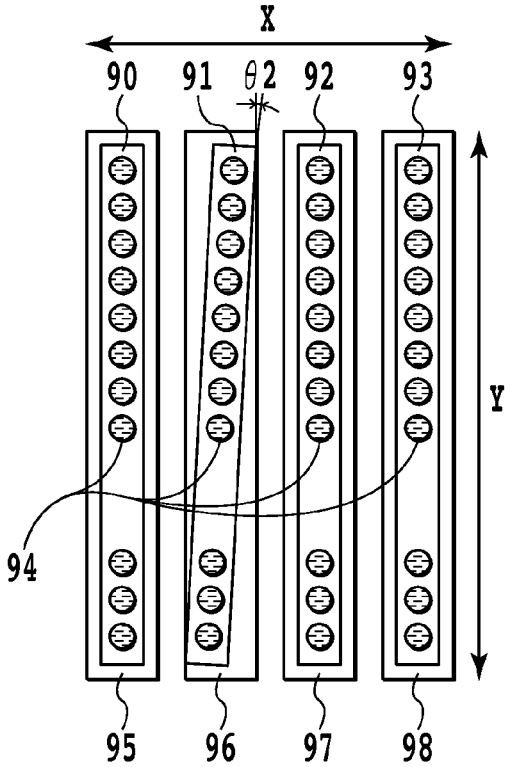
FIGS. 6A to 6D are schematic diagrams for explaining a printing position deviation produced by an inclination of the printing head and an inclination of the carriage.

FIGS. 6A to 6D are schematic diagrams for explaining the printing position deviation produced by the inclination of the printing head and the inclination of the carriage disposed in the printing apparatus. FIG. 6A shows a state where the inclination $\theta 1$ to the Y-direction of the carriage 95 is zero, but a printing head 91 is inclined to the carriage 95 by $\theta 2$. In this case, since the image affected by an influence of the inclination $\theta 2$ of the printing head is printed on the printing medium, when performing the printing, a correction of about $-\theta 2$ becomes necessary.

Figure 6C:
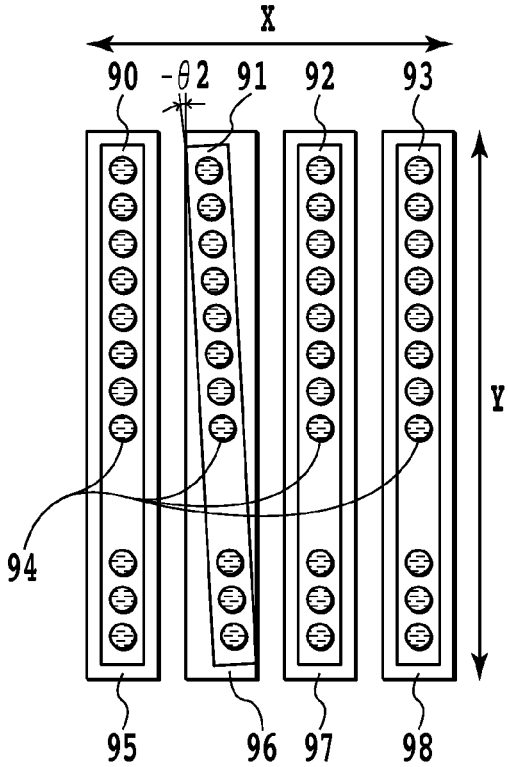
Figure 6B:
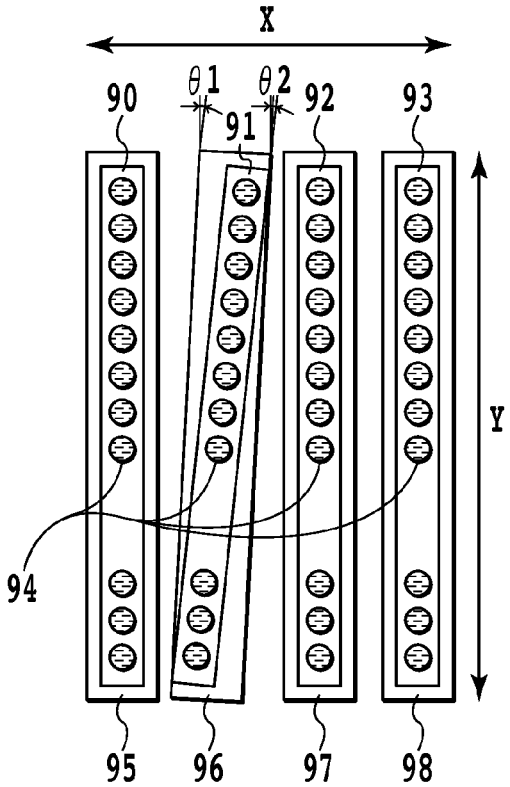

Moreover, FIG. 6B shows a state where the carriage 95 is inclined to the conveyance direction (the Y-direction) by $\theta 1$ and the printing head 91 is also inclined to the carriage 95 further by $\theta 2$. In this case, since the image affected by an influence of $\theta 3$ that is a sum of the inclination $\theta 1$ of the carriage and the inclination $\theta 2$ of the printing head is printed on the printing medium, when performing printing, a correction of about $-\theta 3 \approx -(\theta 1+\theta 2)$ becomes necessary.

On the other hand, FIG. 6C shows a state where although the inclination $\theta 1$ of the carriage to the conveyance direction is zero, the printing head 91 is inclined to the carriage 95 by $-\theta 2$. In this case, since the image affected by an influence of an inclination $-\theta 2$ of the printing head is printed on the printing medium, when performing the printing, a correction of about $+\theta 2$ becomes necessary.

Figure 6D:
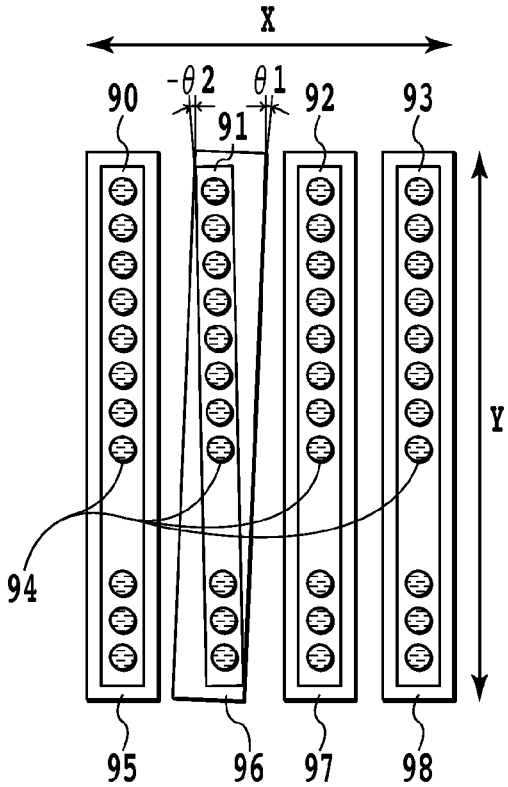

Further, FIG. 6D shows a state where although the carriage is inclined to the conveyance direction (the Y-direction) by $\theta 1$, the printing head 91 is inclined to the printing head 91 by $\theta 2$ in a direction opposite to $\theta 1$. In this case, since an image affected by an influence of $\theta 4$ that is a sum of the inclination $\theta 1$ of the carriage and the inclination $-\theta 2$ of the printing head is printed on the printing medium, when performing the printing, a correction of about $-\theta 4=-(\theta 1-\theta 2)$ becomes necessary. In the figure, since a relationship $\theta 1 \approx \theta 2$ stands, a special correction is not needed even when such inclinations are included in the carriage and the printing head.

In this way, at the position where a dot is actually printed on the printing medium, the position deviations of both the carriage and the printing head have influenced, and, in the case of the printing apparatus whose printing head is exchangeable, a necessary correction quantity varies because a combination of the printing apparatus and the printing head changes.

Figure 5:
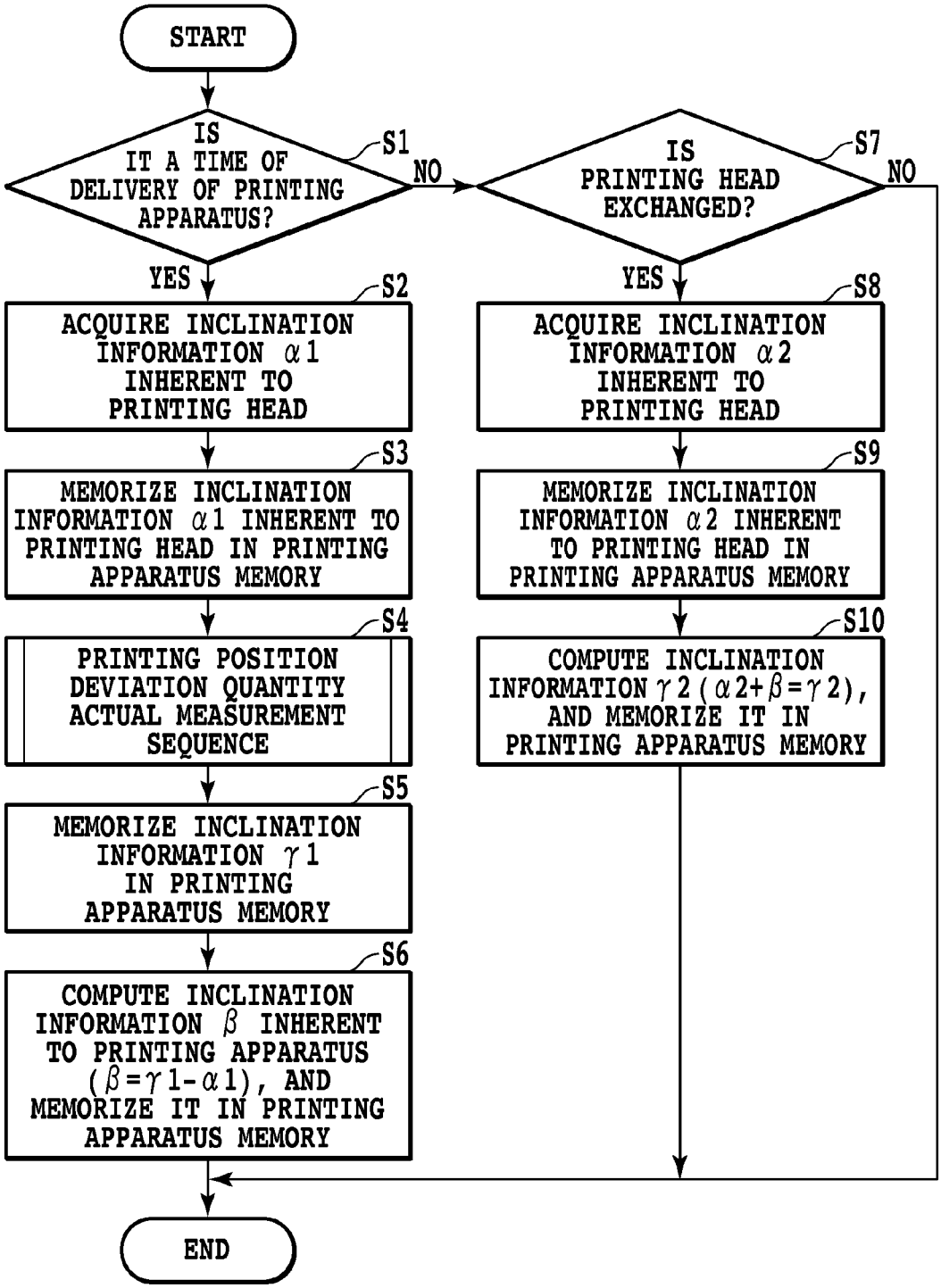
FIG. 5 is a flowchart of a printing position adjustment sequence in a first embodiment.

FIG. 5 is a flowchart for explaining a printing position adjustment sequence in this embodiment. When the printing position adjustment sequence starts, first, at Step S1, the CPU 201 determines whether this printing position adjustment sequence is the first execution after the time of delivery of the apparatus. If it is determined that it is the first execution, the process will proceed to Step S2.

Figure 7:
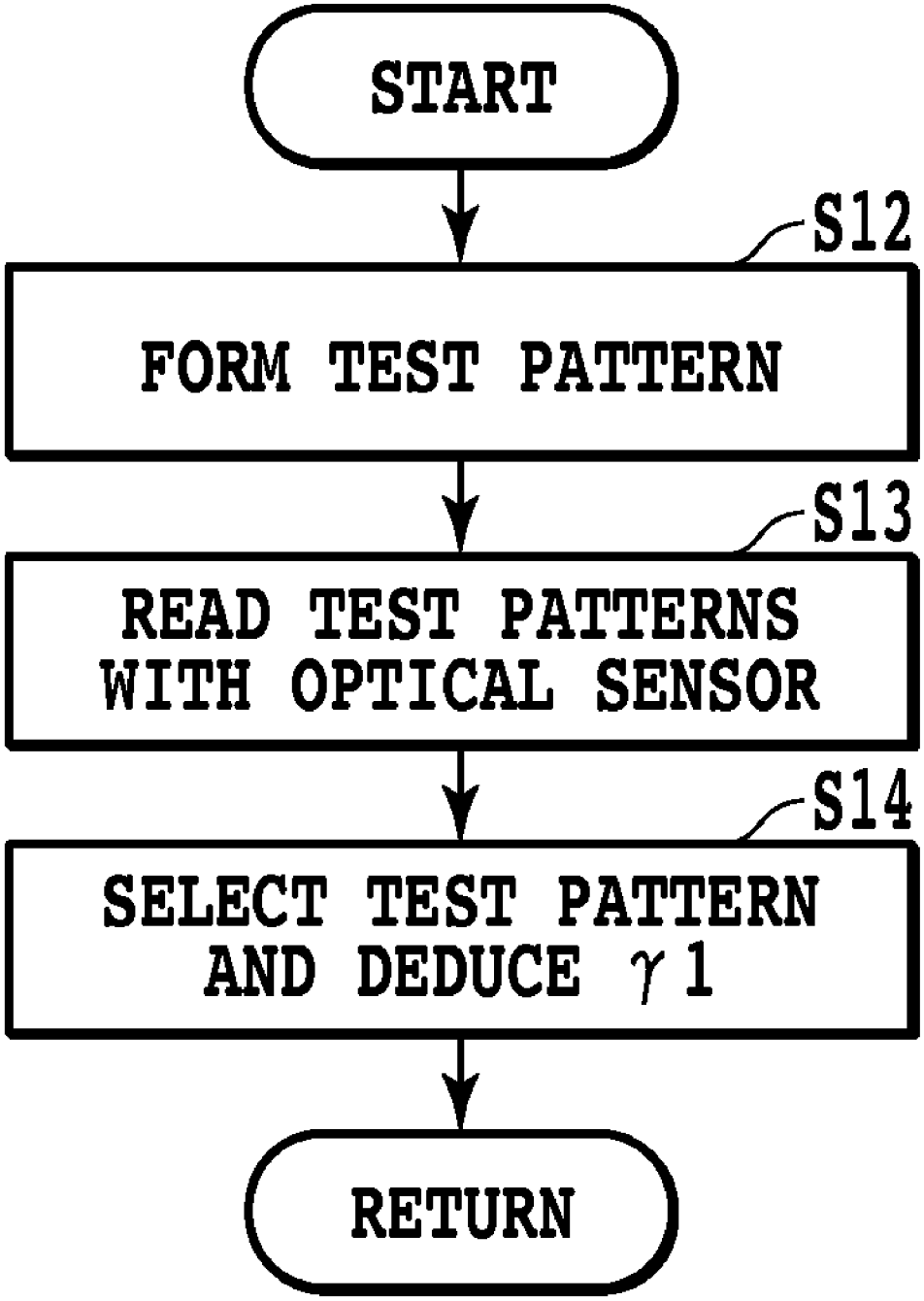
FIG. 7 is a flowchart showing steps of an actual measurement sequence of the printing position deviation.

At Step S2, inclination information $\alpha 1$ inherent to the printing head that is stored in the memory of the printing head is acquired, and at Step S3, this is primarily memorized in the RAM 207 of the printing apparatus as the first parameter. At succeeding Step S4, the actual measurement sequence of a printing position deviation quantity is performed. FIG. 7 is a flowchart for explaining steps of an actual measurement sequence of the printing position deviation quantity that are performed at Step S4. When this sequence is started, the CPU 201 prints a test pattern on the printing medium in accordance with print data stored in advance in the ROM 202 at Step S12.

Figure 9A:
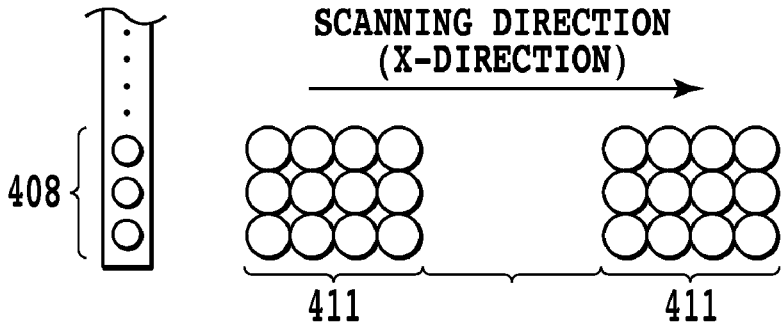
FIGS. 9A and 9B are diagrams for explaining a method for printing a test pattern.
Figure 9B:
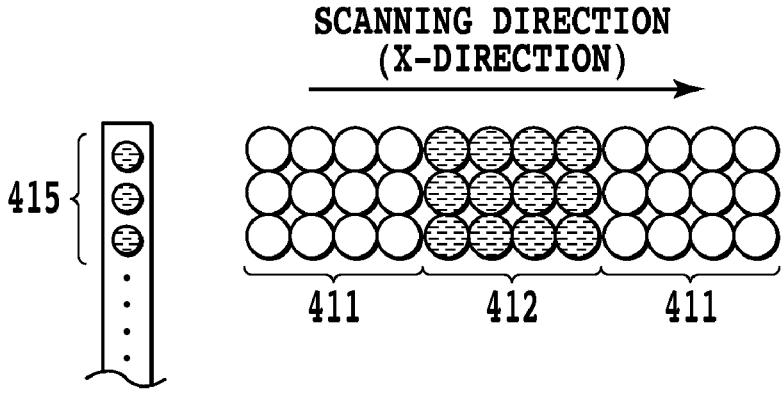

FIGS. 9A and 9B are schematic diagrams for explaining a method for printing the test pattern that will be printed at Step S12. When the printing medium is fed, first the CPU 201 prints a pattern like FIG. 9A by ejecting the inks from three ejection outlets 408 located on the downstream side of the printing head in an outward scan of the printing head. That is, after printing the continuous dots 411, a space of a predetermined quantity is left and the continuous dots 411 are further printed. After that, the CPU 201 conveys the printing medium to a position at which three ejection outlets 415 on the upstream side of the printing head can print the same area as that of the pattern shown in FIG. 9A. Next, again in the outward scan of the printing head, continuous dots 412 shown in FIG. 9B are printed at the position of the figure, i.e., a position that was set to be a space in FIG. 9A by ejecting the ink from the ejection outlets 415. Although the number of dots continuously printed by one printing scan is set to four in the figure, dots whose number is greater than this may be printed practically.

Here, if the ejection outlet array of the printing head does not have the inclination to the conveyance direction (the Y-direction) of the printing medium, positions of the dots printed by two scans become like FIG. 9B. However, if the ejection outlet array of the printing head has the inclination in the Y-direction, these dots are not arranged like FIG. 9B.

Figure 11:
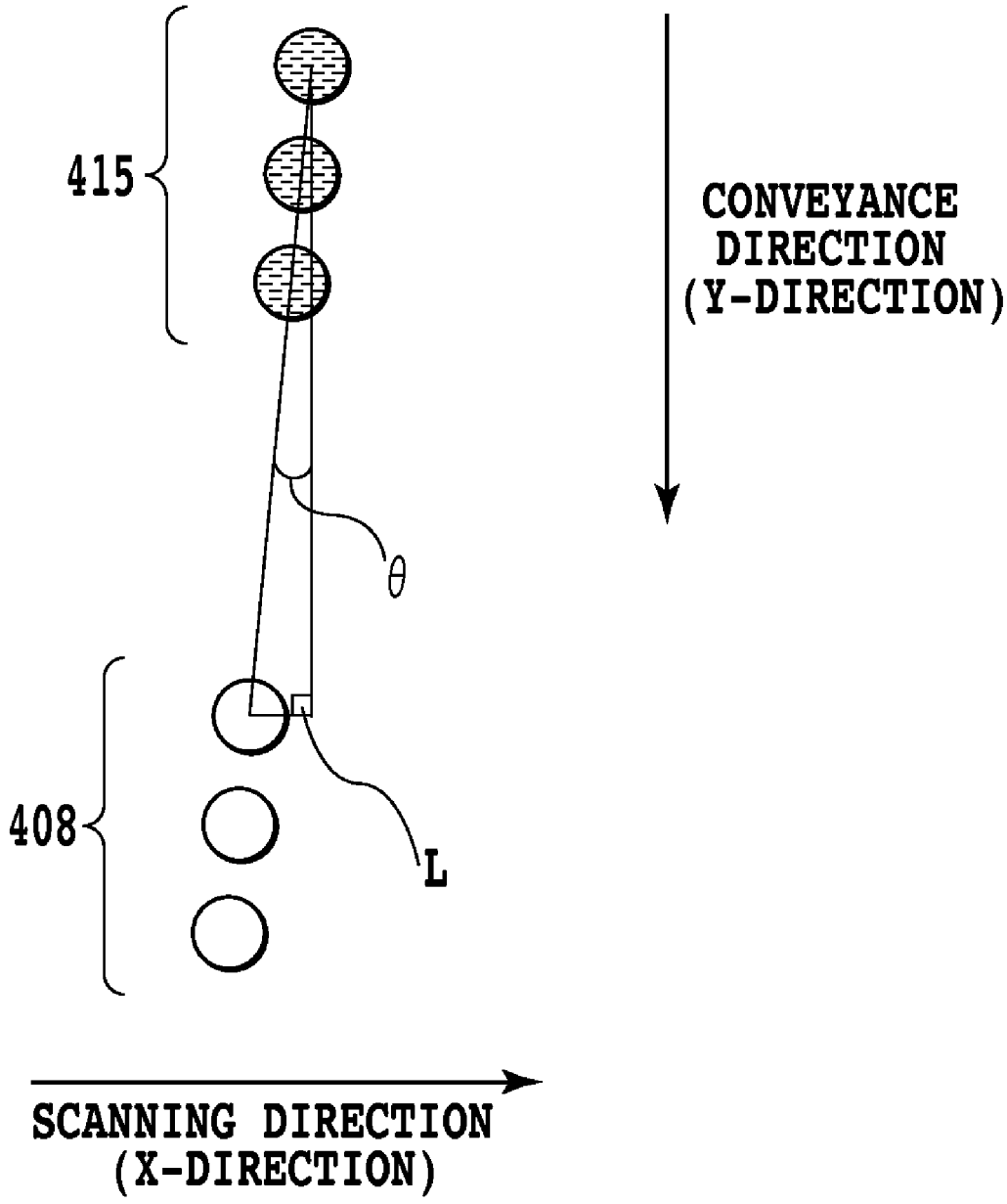
FIG. 11 is a diagram showing a relationship of the inclination of an ejection outlet array and the printing position deviation in the printing head.

FIG. 11 is a diagram for explaining a relationship between the inclination of the ejection outlet array in the printing head and the printing position deviations of the three ejection outlets 415 on the upstream side and the three ejection outlets 408 on the downstream side. Here, shown is a case where the ejection outlet array has an inclination $\theta$ to the conveyance direction (the Y-direction) of the printing medium, and a deviation L is generated at printing positions in the main scanning direction (the X-direction) between the ejection outlet located on an uppermost stream and the ejection outlets located at a third position from a lowermost stream.

Figure 10A:
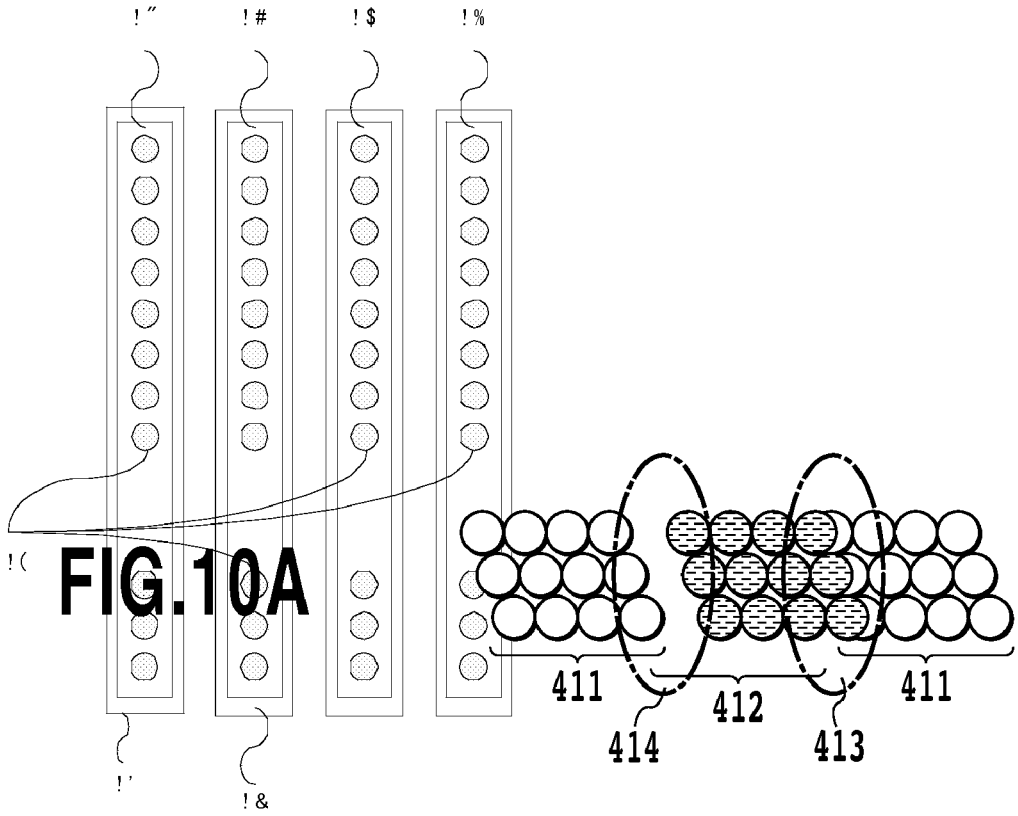
FIGS. 10A and 10B are schematic diagrams for explaining a placement of dot groups in the test pattern and a generation state of a black streak and a white streak.
Figure 10B:
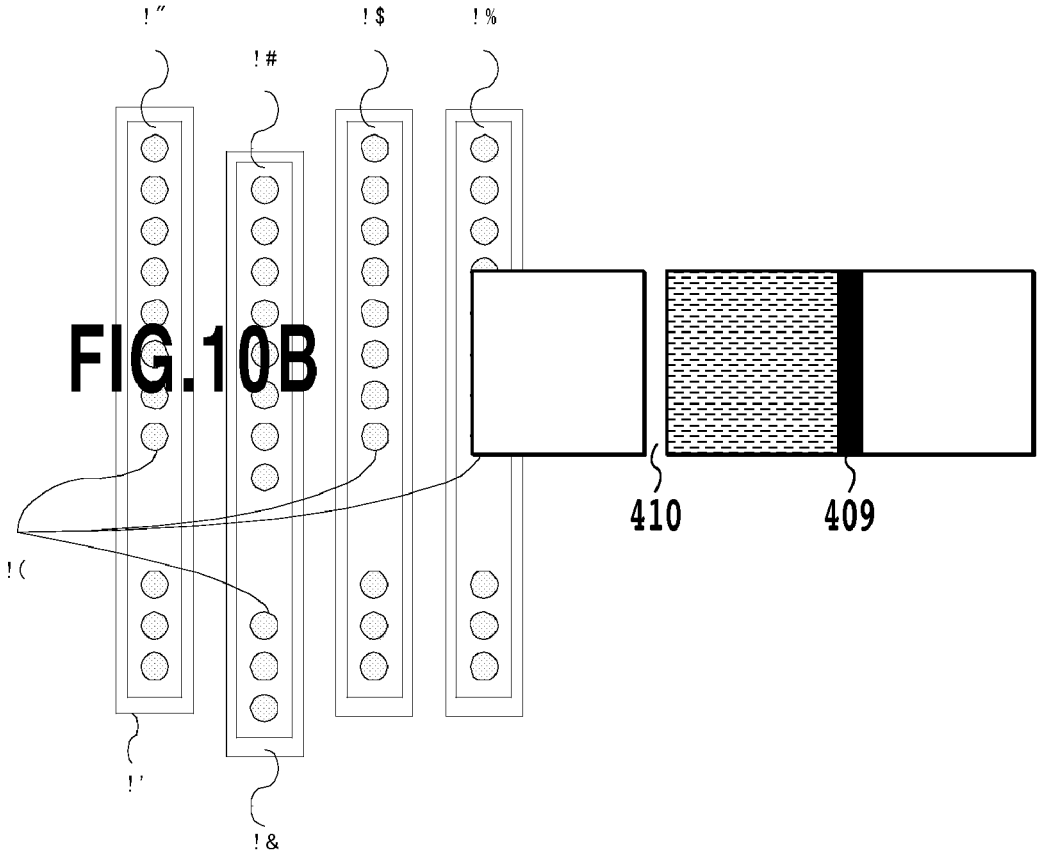

FIGS. 10A and 10B are schematic diagrams for explaining a placement of dot groups and a generation state of a black streak and a white streak in the case where the test pattern is printed by the ejection outlet array shown in FIG. 11 according to the process described above. As is seen in FIG. 10A, if the inclination to the Y-direction is included in the ejection outlet array, the dot groups printed by two printing scans will be placed like FIG. 10A. That is, not only each dot group is placed inclined, but also an overlapped portion 413 and a separation portion 414 are generated between the dot group 411 printed by the ejection outlets 408 and the dot group 412 printed by the ejection outlets 415. As a result, when these patterns are checked visually, a black streak 409 and a white streak 410 will come to be identified in a uniform pattern, as shown in FIG. 10B.

Figure 8:
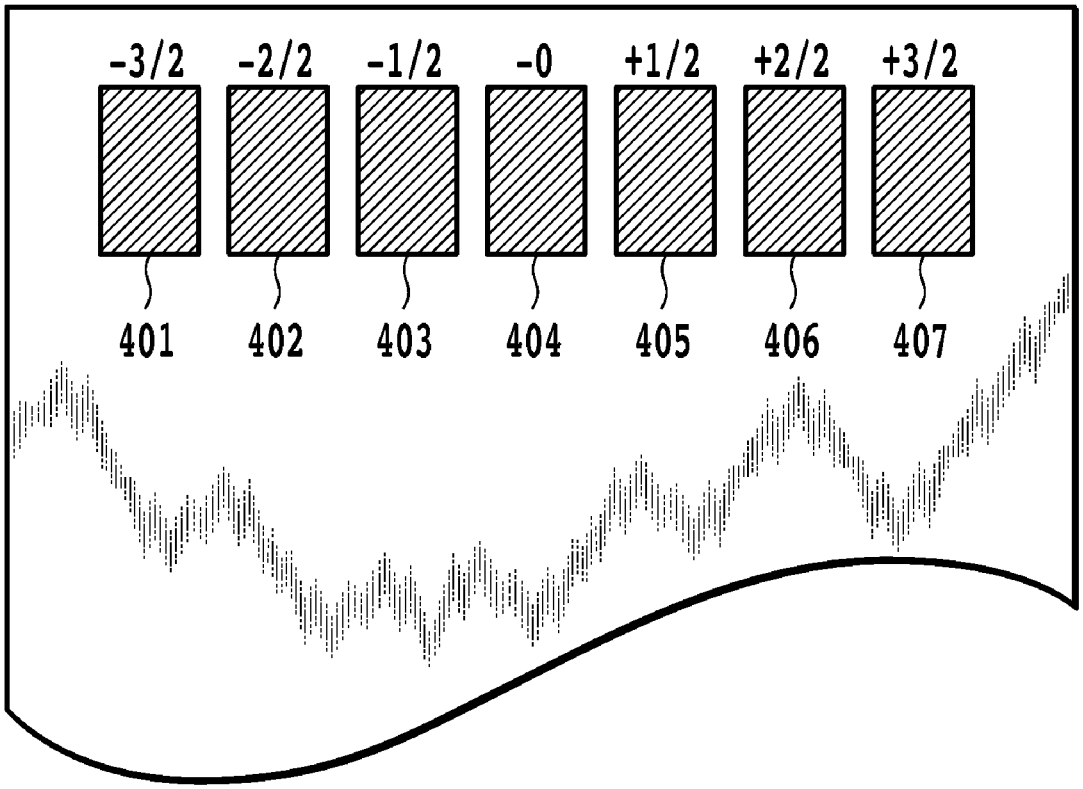
FIG. 8 is a diagram for explaining a test pattern of the actual measurement sequence.

FIG. 8 is a diagram showing a result of having printed a plurality of patterns while an ejection timing from the ejection outlets 415 is shifted stepwisely in the second printing scan. A pattern 404 is a pattern that is printed without shifting the ejection timing from the ejection outlets 415 as compared with the ejection timing from the ejection outlets 408, that is, a pattern with a shift quantity of zero. Patterns 401 to 403 are patterns printed with the ejection timing from the ejection outlets 415 being hastened stepwisely as compared with the ejection timing from the ejection outlets 408. Specifically, the printing is performed while the ejection timing from the ejection outlets 415 is hastened by an amount of 3/2 pixel in the pattern 401, by an amount of one pixel in the pattern 402, and by an amount of a 1/2 pixel in the pattern 403. On the other hand, patterns 405 to 407 are patterns printed with the ejection timing from the ejection outlets 415 being delayed stepwisely as compared with the ejection timing from the ejection outlets 408. Specifically, the printing is performed while the ejection timing from the ejection outlets 415 is delayed by the amount of a 1/2 pixel in the pattern 405, by an amount of one pixel in the pattern 406, and by an amount of 3/2 pixel in the pattern 407. Thus, when a plurality of patterns such that the ejection timing from the ejection outlet 415, i.e., the printing position, is made stepwisely different are printed, a generation state of the black streak 409 and the white streak 410 shown in FIG. 10B is different depending on the pattern. In this embodiment, inclination quantities of the printing apparatus and the printing head are grasped by detecting a generation state of the black streak and the white streak like this.

The explanation returns to the flowchart of FIG. 7. When the printing of the test pattern as described above is completed, the CPU 201 performs a reading operation of each pattern using the optical sensor at Step S13. Specifically, the CPU 201 makes the carriage 2 scan a plurality of patterns and reads density distributions of the respective patterns with the optical sensor mounted on the carriage 2. After that, the process proceeds to Step S14, where a pattern with least density fluctuation, i.e., a pattern with most reduced black streak and white streak is selected among a plurality of patterns that were read.

Figure 12A:
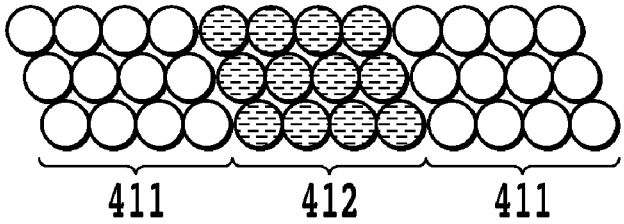
FIGS. 12A and 12B are diagrams showing the test patterns free from the printing position deviation.
Figure 12B:
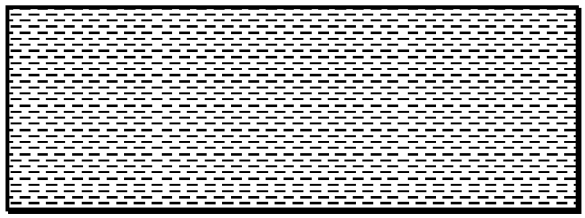

Supposing that the pattern selected here is 402 of FIG. 8, the printing state of the pattern 402 will be the state of FIGS. 12A and 12B, or a state nearest to this among the plurality of patterns. So, this means, when referring to FIG. 11, that a deviation L of the printing position resulting from the inclination Θ of the ejection outlet array to the conveyance direction (the Y-direction) is equivalent to a value that is corrected by hastening an ejection operation from the ejection outlets 415 by one pixel, i.e., one pixel. Therefore, at Step S14, an inclination amount (inclination information) γ1 of the ejection outlet array to the conveyance direction that results from a current combination of the printing apparatus and the printing head is deduced from that value. Upon completion of the procedure, the actual measurement sequence of the printing position deviation quantity will be completed.

Incidentally, here, although the sequence was explained supposing that a pattern with least density fluctuation was selected out of a plurality of patterns and the inclination information γ1 of the ejection outlet array was deduced, the selection criterion of the pattern and a method for determining the inclination amount are not limited to this. For example, in the case where in the optical density that the optical sensor detects, when an optical density fall by the white streak is larger than an optical density rise by the black streak, a pattern whose average density over the whole pattern is the highest may be selected. Alternatively, it is also possible to approximate a relationship of the inclination amount and the optical density using a linear expression or higher-order polynomial expression from the shift quantity (the number of shifted pixels) and the average density of the individual pattern and to compute a more accurate inclination amount from the obtained approximate curve.

The explanation returns to the flowchart of FIG. 5 again. When the actual measurement sequence of the printing position deviation quantity is completed at Step S4, the process proceeds to Step S5, where the inclination amount (the inclination information) γ1 acquired by the actual measurement sequence of the printing position deviation quantity is primarily memorized in the memory (RAM 207) in the printing apparatus as a second parameter.

After that, the process proceeds to Step S6, where an inclination amount β related to the printing apparatus is computed from the inclination amount γ1 memorized at Step S5 and an inclination amount α1 of the printing head memorized at Step S3. The inclination amount γ1 acquired at Step S4 is a value acquired by actually printing the test pattern with the printing head mounted on the printing apparatus. That is, this inclination amount γ1 is an inclination amount in which the inclination amount β1 inherent to the printing apparatus and the inclination amount α1 inherent to the printing head are composed. Therefore, at Step S6, the inclination amount β inherent to the printing apparatus is acquired by subtracting the inclination amount α1 inherent to the printing head that is acquired in advance from the inclination amount γ1 obtained by the actual measurement ($\beta=\gamma 1-\alpha 1$), and the inclination amount β is stored in the memory (RAM 207) of the printing apparatus as a third parameter. The inclination amount β (the third parameter) inherent to this printing apparatus does not vary even if exchange of the printing head is done after that.

On the other hand, when it is determined that this printing position adjustment sequence is not the first after the time of the delivery of the apparatus at Step S1, the process proceeds to Step S7.

At Step S7, it is determined whether the printing head is exchanged after the printing position adjustment sequence was performed last time. If it is determined that the printing head is not exchanged, it will be determined that it is not necessary to perform the printing position adjustment sequence this time, and this processing will be ended. On the other hand, if it is determined that the printing head is exchanged, the process will proceed to Step S8, where an inclination amount α2 of this printing head will be acquired from the memory of the new printing head currently mounted. After that, at Step S9, the inclination amount α2 is stored in the memory of the printing apparatus as the first parameter.

At succeeding Step S10, an inclination amount γ2 of the ejection outlet array to the conveyance direction resulting from a current combination of the printing apparatus and the printing head is computed from the inclination amount β inherent to the printing apparatus stored in the memory (RAM 207) of the printing apparatus and the inclination amount α2 inherent to the printing head memorized at Step S9. That is, γ2 is computed by defining $\gamma 2=\alpha 2+\beta$, and this is memorized in the memory as a new second parameter of the printing apparatus. After doing the above, this processing is ended.

When actually performing the printing, what is necessary is for the CPU just to perform control so that each ejection outlet may eject the ink with a shifted timing based on an occasional γ, i.e. the inclination of the ejection outlet array relative, to the conveyance direction. Specifically, if the inclination γ of the ejection outlet array to the conveyance direction is, for example, Θ (γ=Θ) shown in FIG. 11, what is necessary is that a correction such that printing is done with the ejection from the ejection outlets 415 advanced to the ejection outlets 408 by one pixel should just be performed. In addition, in the case where the ejection outlet array is inclined, in fact, all the ejection outlets have different deviations that differ mutually little by little to a top ejection outlet, it is preferable to shift the ejection timing for the each ejection outlet appropriately to that of the top ejection outlet. However, the minimum unit by which the ejection timing is shifted has limitation because of the configuration of the printing apparatus, and generally the minimum unit is not so fine. Therefore, if the printing apparatus is of a configuration that can control the ejection timing using a 1/2 pixel as a minimum unit, what is necessary is to appropriately set the ejection timing using a 1/2 pixel as the minimum unit.

Moreover, although the above embodiment was explained with a description that the inclination amount of the ejection outlet array to the Y-direction, the inclination amount inherent to the printing apparatus, and the inclination amount inherent to the printing head are acquired, respectively, and these are stored in the memory of the printing apparatus, the parameter to memorize may be not the inclination amount but an actual correction value. In this case, the correction value is equivalent to a value for adjusting the ejection timing from each ejection outlet and, for example, the correction value can be set to +1 in the case where the ink is ejected at a timing later than the reference value by one pixel. Similarly, the correction value can be set to −1 in the case where the ink is ejected at a timing earlier than the reference value by one pixel. Moreover, if the printing apparatus is of a configuration of being capable of controlling the ejection timing using a 1/2 pixel as a minimum unit as described above, it is also possible to set to unity a minimum unit by which the ejection timing can be controlled and to set to +2 (−2) a correction value in the case where the ink is ejected at a timing later (earlier) than the reference value by one pixel. Even if such correction values are replaced with $\alpha$, $\beta$, and $\gamma$, a relationship $\gamma=\alpha+\beta$ can be maintained. In all cases, if it can be done to independently manage the first parameter $\alpha$ related to the inclination amount inherent to the printing apparatus and the third parameter $\beta$ related to the inclination amount inherent to the printing head and to derive the second parameter $\gamma$ related to the actual inclination amount of the ejection outlet array to the Y-direction, this embodiment will function effectively.

According to this embodiment explained above, only at the time of delivery of the printing apparatus, printing of such a pattern as explained in FIG. 9 and reading of the pattern with the optical sensor are performed, so that the inclination amount of the ejection outlet array to the conveyance direction (the Y-direction) is actually measured. After that, when the printing head is exchanged or other cases, it is possible to properly perform the correction of the printing position only by reading information of the inclination amount inherent to the printing head memorized in the printing head, without performing the printing or reading of the test pattern. Therefore, it is possible to control low a time needed to print many test patterns and to detect these and consumables, and even if the exchange of the printing head is done, it becomes possible to stably output a uniform image free from the printing position deviation.

Incidentally, as was explained already, in the actual printing position deviations, there exist various printing position deviations, such as the printing position deviation between the outward scan and the return scan, and the printing position deviation among ink colors (among the printing heads) in the X-direction or the Y-direction, in addition to the printing position deviation accompanying the above-mentioned inclination of the nozzle array. Regarding these printing position deviations, the deviation quantities can be acquired separately by printing the test pattern appropriate to each of them and by detecting these test patterns using the optical sensor. Then, the printing step of these test patterns and the detection step thereof using the optical sensor can be performed simultaneously with the step of detecting the inclination amount in Step S12 and Step S13 in the flowchart explained in FIG. 7.

Second Embodiment

In the ink jet printing head equipped with a heater, there may be a case where energy being put into the ink is not maintained at a proper quantity even when the same voltage pulse is applied to the heater because a color material component is accumulated on a heater surface or a protective film on the heater surface deteriorates as the number of times of ejection increases. In this case, a fluctuation of input energy affects speed and quantity of the ejected ink droplets, and thereby there may be a case where the deviation occurs in printing position on the printing medium even when the printing is performed at the same timing.

Figure 13:
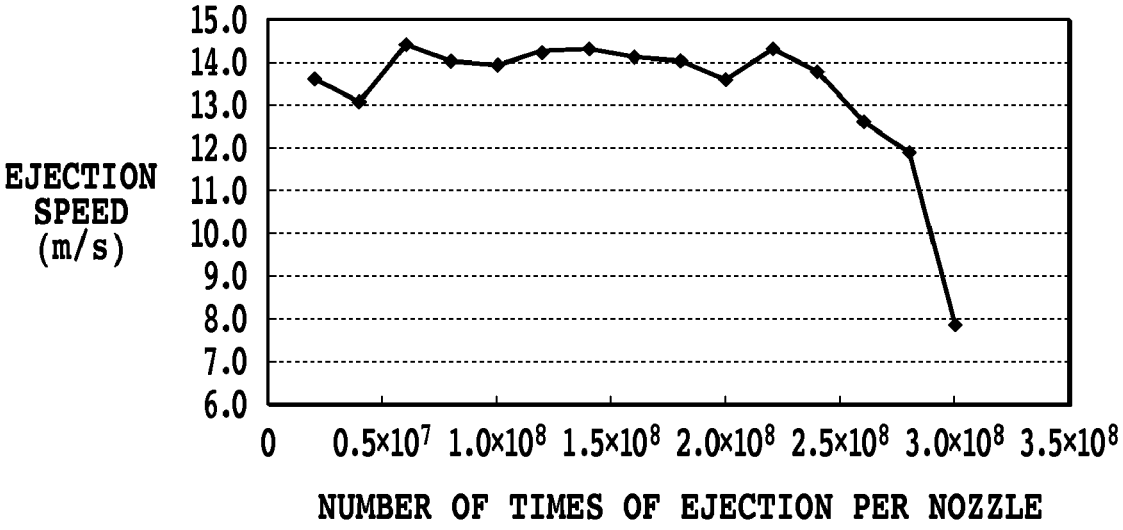
FIG. 13 is a diagram of a measurement result of variation in ejection speed of ink droplets as a function of the number of times of ejection of a single nozzle.

FIG. 13 is a diagram showing a variation of the ejection speed of the ink droplet as the number of ejection times of one nozzle. The ejection speed of the ink droplet falls rapidly when the number of ejection times reaches a certain level. If this relationship between the number of ejection times and the ejection speed can be grasped, it is possible to predict a degree of the printing position deviation that varies with the number of ejection times.

This embodiment is characterized by adopting the same configuration as that of the first embodiment, and also by adding adjustment to the correction quantity of the printing position deviation by predicting a variation of the printing position deviation accompanying the number of times of ejection by some degree. Therefore, the printing apparatus of this embodiment shall be equipped with means for counting the number of times of ejection of the printing head mounted thereon and means for memorizing the number of times of ejection. Then, since it is difficult to manage the number of times of ejection for each ejection outlet in fact, an average of the number of times of ejection of each ejection outlet is found from the number of times of ejection of the whole printing head, and this value is used as a standard of the adjustment.

Figure 14:
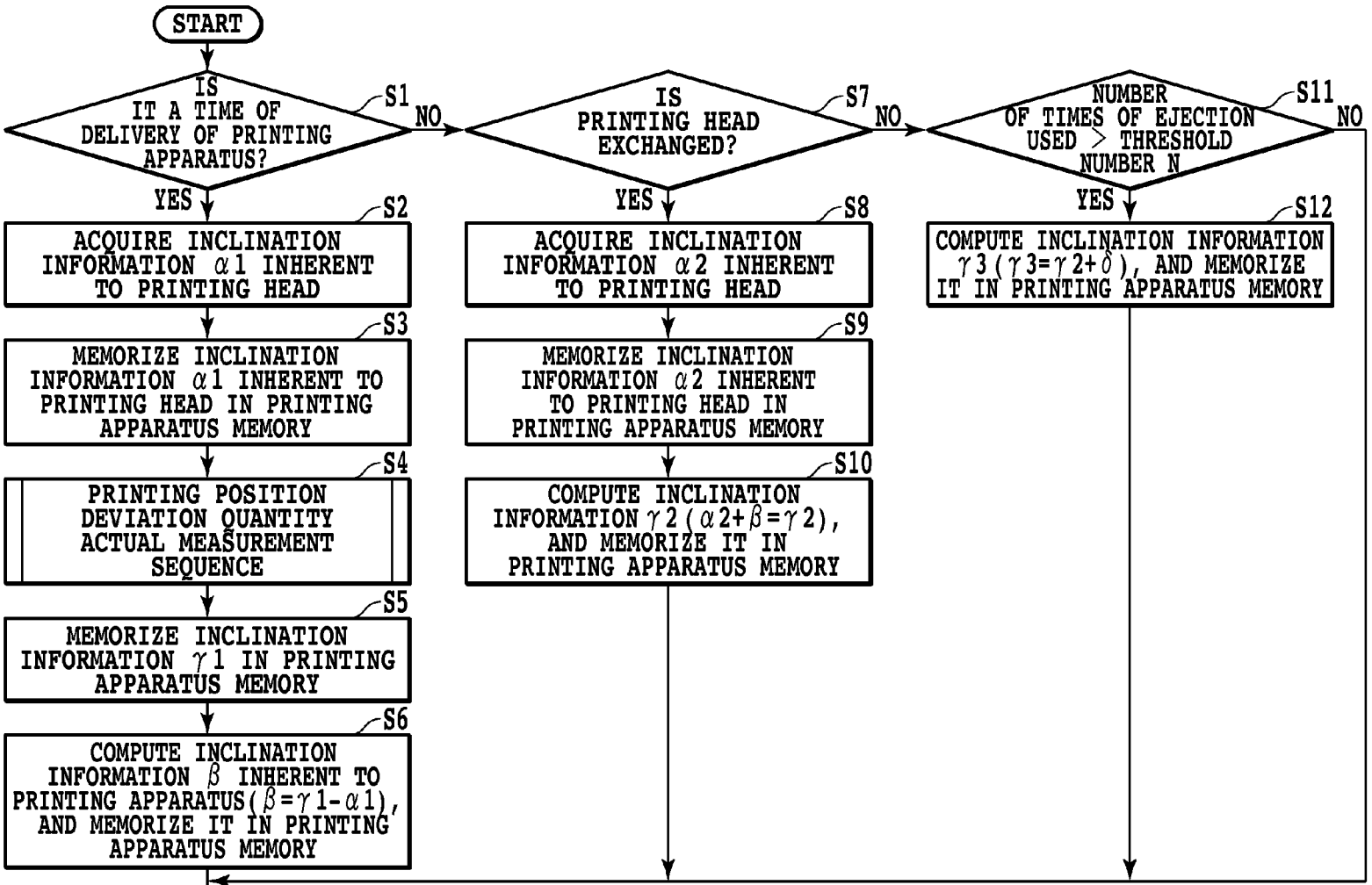
FIG. 14 is a flowchart of the printing position adjustment sequence in a second embodiment.

FIG. 14 is a flowchart for explaining the printing position adjustment sequence in this embodiment. Since each step of Step S1 to Step S10 is the same as that of the first embodiment, their explanations are omitted.

In this embodiment, at Step S7, if it is determined that the printing head currently mounted is not exchanged from a time when the printing position adjustment sequence was performed last time, the process proceeds to Step S11 and determines whether the number of times of ejection of the each printing head is equal to or more than a threshold N. If it is determined that the number of times of ejection is equal to or more than the threshold N, the process will proceed to Step S12, where a new inclination amount $\gamma\mathbf{3}=\gamma\mathbf{2}+\delta$ will be computed by adding an adjustment value $\delta$ to the inclination amount $\gamma\mathbf{2}$ currently grasped. On the other hand, if it is determined that the number of times of ejection of the printing head is neither equal to nor more than the threshold N at Step S11, it will be determined that there is no necessity of performing the printing position adjustment sequence this time, and this processing will be ended.

According to this embodiment explained above, similarly with the first embodiment, the inclination amount of the nozzle array to the conveyance direction is actually measured by performing the printing of the test pattern and the reading of the pattern with the optical sensor only at the time of delivery of the printing apparatus. Then, when the printing head is exchanged, information of the inclination amount inherent to the printing head that is memorized in the printing head is read, and if the number of times of ejection of the printing head is large, a correction is given to the deviation quantity of the printing position depending on the number of times of ejection. This configuration makes it possible to stably output the uniform image by performing an appropriate correction to the printing position deviation while controlling small a time and the consumables required to grasp the printing position deviation quantity.

Incidentally, in this embodiment, it is also possible to prepare values of the adjustment value δ for multiple stages depending on the number of times of ejection. FIG. 15 is a diagram showing a relationship of the number of times of ejection of the printing head and the adjustment value δ in the case of setting the adjustment value to the correction value to be in the multiple stages. Here, when the number of times of ejection is zero to $2.5\times10^8$, the adjustment value δ is zero. That is, γ3 becomes γ3=γ2 in this case. On the other hand, when the number of times of ejection of the printing head is $2.5\times10^8$ to $3.0\times10^8$, the adjustment value δ becomes 2; when the number of times of ejection of the printing head is larger than $3.0\times10^8$, the adjustment value δ becomes 4. Step S12 of this embodiment may be modified to acquire the new inclination amount γ3 by performing the adjustment depending on the number of times of ejection of the printing head in this way. Moreover, when the number of times of ejection is equal to or more than N, the adjustment by the adjustment value δ is performed, but if the number of times of ejection has reached a further large value, the step may be modified to urge a user to exchange the printing head.

Incidentally, in the embodiment explained above, although the explanation was given based on the premise that each one of the printing heads is of a configuration that has a single nozzle array, the present invention is not limited to such a configuration. For example, the nozzle array of each color may be of a form constructed with two nozzle arrays whose ejection outlets are placed on the right and left sides alternately. Moreover, the printing head may have a configuration such that only the ejection outlet array 90 of black is larger than the ink ejection outlet arrays 91, 92, and 93 of other colors in the number of the ink ejection outlets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-148826, filed Jun. 23, 2009, which is hereby incorporated by reference herein in its entirety.

What is claimed is:

1. A printing apparatus comprising:

a mounting unit configured to mount a printing head in which a plurality of ejection outlets ejecting an ink are arranged, the printing head storing a first parameter related to a printing position deviation inherent to the printing head;

a printing unit configured to print dots on a printing medium by ejecting the ink from the printing head;

a detecting unit configured to detect the printing position deviation with the printing head mounted on the printing apparatus;

a first storage unit configured to store a second parameter related to the printing position deviation with the printing head mounted on the printing apparatus;

a correction unit configured to correct positions at which the printing head prints dots on the printing medium according to the second parameter;

a derivation unit configured to derive a third parameter related to the printing position deviation inherent to the printing apparatus from the first parameter and the second parameter;

a second storage unit configured to store the third parameter; and updating unit configured to update the second parameter, when a new printing head is mounted on the printing apparatus, from the third parameter and the first parameter of the new printing head.

2. The printing apparatus according to claim 1, wherein the detecting unit detects the printing position deviation by detecting a test pattern printed with the printing head mounted on the printing apparatus using an optical sensor.

3. The printing apparatus according to claim 1, wherein the printing position deviation is a printing position deviation that results from an inclination of an arrangement direction of the plurality of ejection outlets.

4. The printing apparatus according to claim 1, further comprising a unit configured to move the printing head in a direction crossing the arrangement direction of the plurality of ejection outlets, wherein the printing position deviation is a deviation between a printing position of the dot printed during an outward scan of the printing head and a printing position of the dot printed during a return scan of the printing head.

5. The printing apparatus according to claim 1, wherein the printing apparatus uses a plurality of printing heads that eject mutually different inks and the printing position deviation is a printing position deviation among the plurality of the printing heads.

6. The printing apparatus according to claim 1, further comprising a counting unit configured to count the number of times of ejection, wherein the updating unit updates the second parameter based on the number of times of ejection counted by the counting unit.

7. A method for adjusting printing positions, comprising steps for:

mounting a printing head for printing dots on a printing medium to a printing apparatus, the printing head storing a first parameter related to a printing position deviation inherent to the printing head;

detecting the printing position deviation with the printing head mounted on the printing apparatus;

storing a second parameter related to the printing position deviation with the printing head mounted on the printing apparatus;

correcting positions at which the printing head prints dots on the printing medium according to the second parameter;

deriving a third parameter related to the printing position deviation inherent to the printing apparatus from the first parameter and the second parameter;

storing the third parameter; and updating the second parameter, when a new printing head is mounted on the printing apparatus, from the third parameter and the first parameter of the new printing head.

* * * * *